United States Patent [19]

Lustig

[11] Patent Number: 4,772,235

[45] Date of Patent: Sep. 20, 1988

[54] ELECTRICAL CONNECTOR

[75] Inventor: Israel Lustig, Ramat Gan, Israel

[73] Assignee: Israel Aircraft Industries, Inc., Lod, Israel

[21] Appl. No.: 893,164

[22] Filed: Aug. 5, 1986

[30] Foreign Application Priority Data

May 16, 1986 [IL] Israel ..... 78809

[51] Int. Cl.[4] ..... H01R 4/18

[52] U.S. Cl. ..... 439/866; 439/741

[58] Field of Search ..... 339/776 RT, 223; 439/730, 736, 866–868, 741

[56] References Cited

U.S. PATENT DOCUMENTS

| | | | |
|---|---|---|---|
| 1,650,295 | 11/1927 | Patten | 339/223 R |
| 2,226,849 | 12/1940 | Douglas | 439/866 |
| 2,297,785 | 10/1942 | Lake | 439/866 |
| 2,671,889 | 3/1954 | Vickery | 339/223 R X |
| 2,832,816 | 4/1958 | Curtiss | 439/730 X |
| 2,927,150 | 3/1960 | Amigh et al. | 339/223 R X |
| 3,517,373 | 6/1970 | Jamon | 439/736 X |

FOREIGN PATENT DOCUMENTS

| | | | |
|---|---|---|---|
| 459819 | 9/1949 | Canada | 339/223 R |

*Primary Examiner*—Eugene F. Desmond

*Attorney, Agent, or Firm*—Nixon & Vanderhye

[57] ABSTRACT

An electrical connector for terminating an electrical pin wire, said electrical connector comprising;

a wire barrel having a length and an inside diameter such that both an electrically conductive portion and an electrical insulation jacket portion of said wire are insertable therein, said wire barrel being mechanically crimped to provide at least one point of electrical and mechanical connection to said electrically conductive portion and at least one point of mechanical connection to said electrical insulation jacket portion of said wire.

4 Claims, 1 Drawing Sheet

ELECTRICAL CONNECTOR

FIELD OF THE INVENTION

The present invention relates to electrical pin connectors, more particularly, to pressure connectors for terminating conductors using small wire sizes.

BACKGROUND OF THE INVENTION

The proper design of electrical connectors plays an increasingly important role in the design of electrical circuit wiring. This is especially true in aircraft technologies, because of the requirements imposed by strict safety and reliability standards. Military aircraft present even greater requirements in this regard, in part due to the severe physical stresses that may be experienced by avionics systems. An overall requirement that aircraft weight be minimized presents particular problems for electrical circuit wiring design.

In modern military aircraft, the wiring which is provided for low-current signal communications may constitute as much as 40% of the total length of the wiring on board the aircraft. This percentage continues to increase and is made possible by the development of stronger wires having improved insulation. There is therefore a need to use smaller wire sizes which provide for significant weight reduction. The difference in weight between two wires which are three wire sizes apart may be as much as 50%, such that use of smaller signal wire having wire sizes 24 or 26 is desirable to provide a substantial weight savings over use of larger wire having wire size 22, for example.

However, the smaller signal wire presents difficulties for existing electrical connectors, notably pin connectors. These connectors are of a type wherein an integral wire barrel is designed with an inside diameter appropriate for the wire size being used. An exposed end of the insulated wire is inserted into the wire barrel where it is crimped to provide electrical and mechanical connection to the pin connector. Because of the rigidity of the connection, there is a weak point created in the wire just beyond the wire barrel where exposed wire is sometimes visible. This weak point has presented the very serious problem of breakage, resulting in the increase of electrical failures.

In some designs, the pin connector is encapsulated in an insulation gasket or seal to provide additional strength to the connection. Nevertheless, very often the problem of wire breakage or wire pullout is observed when smaller wire sizes are used due to the existence of the weak point as described above. One solution that has been considered is the use of larger wire sizes, but for existing applications this involves extensive and costly rewiring.

An illustration of the severity of the problem can be recognized in the report that existing military specifications for F-15 and F-16 fighter aircraft were recently revised. Whereas pin connectors using smaller wire having wire sizes 24 and 26 were permitted under MIL-SPEC W5088 Issue J, such pin connectors were eliminated in favor of pin connectors using larger wire having wire size 22 under Issue K. This revision is unfavorable because of the additional weight resulting from the use of the larger wire size, which may amount to as much as 50 kilograms on the aircraft. There is also the significant aspect of rewiring costs involved. These problems have also been encountered in the design of new fighter aircraft such as the Lavi fighter currently being developed by Israel Aircraft Industries.

It would therefore be desirable to eliminate the weak point in wiring terminations made by various types of connectors such as pin connectors which are used for wire terminations of smaller wire sizes.

SUMMARY OF THE INVENTION

It is accordingly a principal object of the invention to overcome the above-mentioned disadvantages and provide an improved electrical pin connector which is constructed so as to solve the problem of wire breakage or wire pullout by elimination of the weak point, thus providing greater safety and reliabilty for electrical circuit wiring.

According to the invention, there is provided an electrical connector for terminating an electrical wire, said electrical pin connector comprising;

a wire barrel having a length and an inside diameter such that both an electrically conductive portion and an electrical insulation jacket portion of said wire are insertable therein, said wire barrel being mechanically crimped to provide at least one point of electrical and mechanical connection to said electrically conductive portion and at least one point of mechanical connection to said electrical insulation jacket portion of said wire.

The double crimping of the wire barrel on each of the conducting and insulating portions of the wire eliminates the weak point existing in prior art pin connectors, thereby solving the problems associated with wire breakage and wire pullout.

In one embodiment, the electrical connector is a pin connector which is encapsulated in an insulation gasket or seal.

In another embodiment, the electrical connector is a pin connector having an insulation sleeve over the wire barrel portion.

In either embodiment, a feature of the invention is the provision of the wire barrel with a stepped inside diameter, such that the inside diameter of the wire barrel posterior portion is smaller than the inside diameter of the wire barrel anterior portion. This provides a shoulder which limits insertion of the wire, while matching the sizes of the conductor and insulation jacket portions of the wire to the wire barrel.

BRIEF DESCRIPTION OF THE DRAWINGS

For better understanding of the invention with regard to the embodiments thereof, reference is made to the accompanying drawings, in which.

DETAILED DESCRIPTION OF A PREFERRED EMBODIMENT

Figure 1:
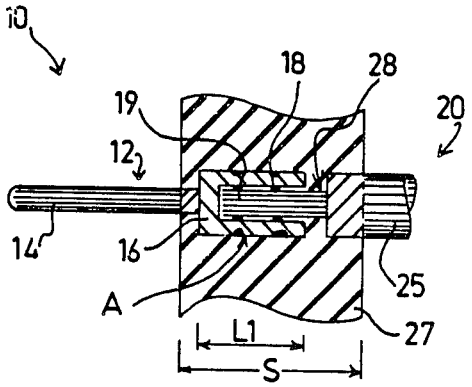
FIG. 1 shows a partial cross-section of a prior art pin connector.

Referring now to FIG. 1, there is shown a partial crosssection of a prior art pin connector 10. The body 12 of the pin connector 10 is made of an electrically conductive material, from which there is integrally formed a pin 14 and a wire barrel 16 having a length L1. The wire barrel 16 has a bore hole 18 therein. Connected to pin connector 10 is an electrical conductor portion 19 of a wire 20, the wire 20 having a length only partially shown. The electrical conductor portion 19 may be either a stranded or solid conductor.

The inside diameter of the wire barrel 16 is designed in accordance with the size of the electrical conductor with which it is to be used. Thus, it is possible to insert conductor portion 19 of the wire 20 into the wire barrel 16. However, in this design, insulation jacket portion 25 of the wire 20 is in proximity to the wire barrel 16, but is not insertable therein. The wire barrel 16 is mechanically crimped over the conductor portion 19 with a crimping tool at the point generally designated A to provide electrical and mechanical connection to the conductor portion 19.

As shown in FIG. 1, the pin connector 10 is encapsulated in an insulation gasket or seal 27. This seal typically has a standard dimension S which is greater than the length L1 of the wire barrel 16 and provides a convenient way of supporting the wire barrel 16 and the wire 20 itself. In any case, there exists a weak point 28 on the conductor portion 19, which presents the possibility of breakage and electrical failure of the circuit in which the wire 20 is connected.

As described earlier, the wire breakage problem has led to the use of larger wires such as wire size 22 which are stronger but are also heavier. In military aircraft applications where smaller and lighter wires such as wire sizes 24 or 26 were being used, replacement with these heavier wires presents the problems of additional weight and costly rewiring procedures.

Figure 2:
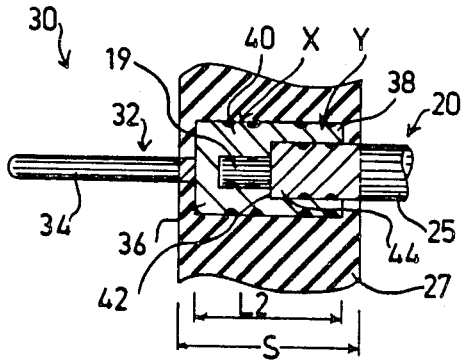
FIG. 2 shows a partial cross-section of a preferred embodiment of a pin connector in accordance with the present invention.

Referring now to FIG. 2, there is shown a partial cross-section of a preferred embodiment of a pin connector 30 in accordance with the invention. The body 32 of the pin connector 30 is made of an electrically conductive material, and is integrally formed in the shape of a pin 34 and a wire barrel 36. The pin connector 30 is shown encapsulated in the insulation gasket or seal 27, although as mentioned earlier, this only provides a convenient support.

The wire barrel 36 has a length L2 and a stepped inside diameter in its anterior and posterior portions 38 and 40. The inside diameter of posterior portion 40 is designed to match the wire size of the electrical conductor 19 inserted therein. A slightly larger inside diameter is provided for the anterior portion 38, which is designed to match the size of insulation jacket 25 of the wire 20. A shoulder 42 is formed between the stepped inside diameters of the anterior and posterior 38 and 40.

As shown in FIG. 2, wire barrel 36 is designed with a length L2 that allows both the electrical conductor portion 19 and the insulation jacket portion 25 of wire 20 to be inserted therein. The length L2 of the wire barrel 36 is preferably made as long as possible within the dimension S of the insulation gasket or seal 27. As the wire 20 is inserted in the wire barrel 36, the shoulder 42 acts as a stop against the edge 44 of the insulation jacket 25, preventing further insertion of the wire 20 into the wire barrel 36.

A pressure connection is made between the wire 20 and the pin connector 30 by mechanical crimping of the wire 20 at points X and Y on the wire barrel 36. Electrical and mechanical connection of the conductor portion 19 is provided by the crimp at point X, while mechanical connection of the insulation jacket portion 25 is provided by the crimp at point Y.

The double crimping of the wire barrel 36 on each of the conducting and insulating portions 19 and 25 of the wire 20 respectively at points X and Y eliminates the weak point existing in prior art pin connectors, thereby providing greater strength and solving the problems associated with wire breakage and wire pullout. The design of pin connector 30 makes this technique possible, leading to the very great advantage that smaller wire sizes are no longer problematic in existing and new electrical circuit wiring designs.

Thus, wire sizes such as wire size 24 or 26 are usable with electrical connectors provided in accordance with the invention in many applications, and weight reduction achievements become very significant as in the case of military aircraft.

In another embodiment, the pin connector 30 may also be provided with an insulation sleeve (not shown) of appropriate length over the wire barrel 36, replacing the insulation gasket or seal 27.

Figure 3:
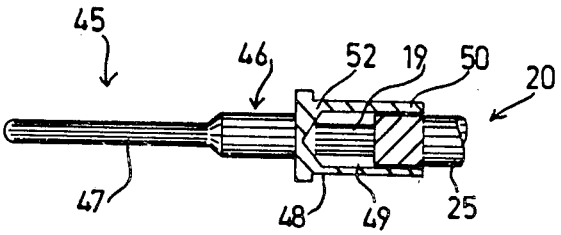
FIG. 3 shows a partial cross-section of a modified pin connector in accordance with the present invention.

Referring now to FIG. 3, there is shown a partial crosssection of a modified pin connector 45 in accordance with the present invention. As in FIG. 2, the body 46 of the pin connector 45 is made of an electrically conductive material and is integrally formed as a pin 47 and a wire barrel 48. The wire barrel 48 has a bore hole 49 therein. In this design, the wire barrel 48 is not provided with a stepped inside diameter. However, both conductor portion 19 and insulation jacket portion 25 of wire 20 are insertable therein. Double mechanical crimping is used as in FIG. 2 on the anterior and posterior portions 50 and 52 of wire barrel 48, although the actual crimping is not shown in the figure. As mentioned earlier, the wire barrel 48 may be provided with an insulation sleeve (not shown) of appropriate length.

Thus, in accordance with the invention, there is provided an electrical connector such as a pin connector which is suitable for use with smaller wire sizes and provides double crimping to eliminate the problem of wire breakage and wire pullout associated with prior art connectors.

While the principles of the invention have been described with regard to specific connectors, it is to be understood that the description is made by way of example only and not as a limitation on the scope of the invention, which is set forth in the appended claims.

I claim:

1. An electrical pin connector for terminating an electrical wire of size 24 and smaller for use in avionic systems, said connector comprising:

an integrally formed wire barrel having a length defined along a longitudinal axis and an inside diameter such that both an electrically conductive portion and an electrical insulation jacket portion of said wire are insertable therein, said wire barrel defining an anterior lip, and being configured to have a stepped inside diameter defining anterior and posterior portions, said posterior portion having a smaller inside diameter than that of said anterior portion, the edge of the posterior portion defining a shoulder which lies in a plane generally perpendicular to said longitudinal axis and which operates as a stop against the facing edge of the insulation jacket, said wire barrel being mechanically double crimped to provide distinct and oppositely directed crimping points of electrical and mechanical connection to said electrically conductive portion and distinct and oppositely directed crimping points of mechanical connection to said electrical insulation jacket portion of said wire, said distinct crimping points of mechanical connection being provided between said anterior lip and said shoulder at a distance from said anterior lip, such that said wire barrel substantially retains its original shape without creating proximate thereto a weak point in said wire beyond said anterior lip.

2. The connector of claim 1 further comprising an insulation gasket or seal for encapsulation of said wire barrel.

3. The connector of claim 1 further comprising an insulation sleeve in which said wire barrel is enclosed.

4. For use in avionic systems, a method of connecting an electrical wire of size 24 and smaller to a pin connector having an integrally formed wire barrel defined along a longitudinal axis and defining an anterior lip, configured to have a stepped inside diameter defining anterior and posterior portions, said posterior portion having a smaller inside diameter than that of said anterior portion, the edge of the posterior portion defining a shoulder which lies in a plane generally perpendicular to said longitudinal axis, said method comprising the steps of:

inserting a bare electrical conductor portion and an adjacent insulator jacket portion of said wire into said wire barrel such that the jacket portion butts up against the shoulder, which operates as a stop against the facing edge fo the insulation jacket; and mechanically double crimping said wire barrel over each of said electrical conductor and said insulator portions of said wire, thereby providing distinct and oppositely directed crimping points of electrical and mechanical connection to said electrically conductive portion, and distinct and oppositely directed crimping points of mechanical connection to said electrical insulation jacket portion of said wire, said distinct points of mechanical connection being provided between said and anterior lip and said shoulder at a distance from said anterior lip, such that said wire barrel substantially retains its original shape without creating proximate thereto a weak point in said wire beyond said anterior lip.

* * * * *